US005715911A

United States Patent [19]

Kunka et al.

[11] Patent Number: 5,715,911

[45] Date of Patent: Feb. 10, 1998

[54] LAMINAR FLOW LUBRICATION

[75] Inventors: James L. Kunka, Powhatan County; Donald R. Haulsee, Chesterfield County, both of Va.

[73] Assignee: Reynolds Metals Company, Richmond, Va.

[21] Appl. No.: 620,436

[22] Filed: Mar. 22, 1996

[51] Int. Cl.[6] ..... F01M 1/00

[52] U.S. Cl. ..... 184/6.9; 184/18; 123/196 R

[58] Field of Search ..... 184/6, 6.5, 6.9, 184/18; 123/196 R

[56] References Cited

U.S. PATENT DOCUMENTS

| | | | |
|---|---|---|---|
| 1,459,819 | 6/1923 | Bonner . | |
| 1,689,319 | 10/1928 | Bonner | 184/6.9 |
| 2,069,745 | 2/1937 | Allen | 184/6.9 |
| 3,285,004 | 11/1966 | Hopley . | |
| 3,345,976 | 10/1967 | Pope et al. | 184/6.9 |
| 3,581,728 | 6/1971 | Abraham et al. . | |
| 3,708,215 | 1/1973 | Wilcock et al. . | |
| 3,951,476 | 4/1976 | Schulien et al. . | |
| 4,022,294 | 5/1977 | Coulin | 184/6.9 |
| 4,413,597 | 11/1983 | Stang et al. | 123/41.42 |
| 4,440,118 | 4/1984 | Stang et al. | 123/41.84 |
| 5,382,292 | 1/1995 | Conroy et al. | 118/324 |
| 5,465,691 | 11/1995 | Capaldo . | |

*Primary Examiner*—Thomas E. Denion
*Attorney, Agent, or Firm*—Robert C. Lyne, Jr.

[57] ABSTRACT

The system provides a lubricating fluid between a wall which defines a cavity and a member which passes through the cavity. The system includes a passageway for supplying lubricating fluid to the cavity at a velocity and a fluid outlet for introducing the fluid from the passageway to the cavity such that a centrifugal force, corresponding to the velocity of the fluid supplied from the passageway, acts on the fluid flowing from the fluid outlet to cause the fluid to have a laminar flow over the cavity wall.

34 Claims, 5 Drawing Sheets

LAMINAR FLOW LUBRICATION

BACKGROUND OF INVENTION

1. Field of Invention

The present invention relates generally to an improved lubricating technique and more particularly to an improved system and method for lubricating sliding surfaces of relatively moving parts and for providing an improved fluid bearing support.

2. Description of Related Art

To reduce friction and thereby avoid the generation of excessive heat and other undesirable effects of friction, lubricants are typically applied between surfaces of adjacent parts or components which move relative with respect to each other. Additionally, such lubricants may be required to serve as a fluid bearing to support the weight of a part or component as it glides past another part component, or to support the weight of a part at a point where its direction of travel is reversed. In the latter case, the fluid bearing serves as a bearing surface for the part while it remains in a stationary position.

For example, in automotive and other internal combustion engines, the valve stem of a poppet valve is typically guided through a valve guide for slidable movement during operation of the internal combustion engine. In such assemblies, lubricant is beneficially provided in such a manner that a consistent and continuous flow of lubricant lubricates the surface of the valve guide cavity and the outer surface of the valve stem to prevent undesirable friction and associated heat generation which would interfere with the proper operation of the engine and could potentially result in engine seizure causing significant damage to the valves and other engine components.

Because it is beneficial for the distance between the outer diameter of the valve stem and the inner diameter of the guide cavity to be minimized, valve lubricating systems have been proposed which provide grooves around the wall of the guide cavity so that lubricant can be dispersed throughout the valve guide cavity by way of such grooves and forced from the grooves onto the cavity wall. In certain proposed systems, the lubricant is provided from the top of the valve guide and flows down the stem to enter the upper end of the guide. One or more spiral feed grooves, tubes or tunnels can be tapped in the valve guide to feed the lubricant to distribute grooves formed throughout the length of the guide to ensure the presence of lubricating fluid in each distribution groove and facilitate the distribution of lubricant between the bearing or sliding surfaces of the stem and guide.

Typically, the reciprocal motion of the valve stem distribute lubricant from the groove to form an oil film over the walls of the guide cavity. Particular configurations of the groove have been proposed to induce scraping of the lubricant off the valve stem as the valve stem moves in one direction within the valve guide and entraining the lubricant onto the valve stem as the valve stem moves in the opposite direction within the valve guide.

Reliance on the relative movement between the valve stem and valve guide for distributing the lubricant over the entire bearing surfaces of the valve stem and valve guide may provide minimally acceptable lubricating characteristics when the valve stem and guide are new. However, as wearing of the valve stem and guide occurs during the operational life of the engine the lubricating characteristics will tend to degrade potentially to an unacceptable level. Further, because movement of the valve stem is required to properly distribute the lubricant, the valve is normally insufficiently lubricated at start-up of the engine.

OBJECTIVES OF INVENTION

Accordingly, an objective of the present invention is to provide a lubricating system that overcomes the above-described problems.

It is yet another objective of the present invention to provide a lubricating system which consistently feeds and distributes lubricant over the entire sliding or bearing surfaces of relatively moving parts or components.

It is a further object of the present invention to provide a system for distributing lubricant between sliding or bearing surfaces of relatively moving parts or components without reliance upon such relative movement of such parts for distribution of the lubricating fluid.

Additional objects, advantages and novel features of the present invention will become apparent to those skilled in the art from this disclosure, including the following detailed description, as well as by the practice of the invention. While the invention is described below with reference to preferred embodiments, it should be understood that the invention is not limited thereto. Those of ordinary skill in the art having access to the teachings herein will recognize additional applications, modifications and embodiments in other fields which are within the scope of the invention as disclosed and claimed herein and with respect to which the invention could be of significant utility.

SUMMARY OF THE INVENTION

In accordance with the present invention, a system is provided for introducing and distributing a lubricating fluid between surfaces of relatively moving parts such as the cavity wall of a valve guide and the valve stem member which passes therethrough. The system includes a passageway, such as a machined tube in the valve guide well, for supplying fluid to the cavity at a velocity and a fluid outlet port for introducing the fluid from the passageway to the cavity. The fluid is introduced to the cavity such that the fluid flows radially along the cavity wall thereby developing a centrifugal force, corresponding to the velocity of the fluid supplied to the cavity via the passageway, which acts on the fluid flowing over the cavity wall to cause the fluid to have a laminar, i.e., non-turbulent, flow.

Preferably, the fluid is directed from the passageway by the fluid outlet to flow substantial tangential to and into a groove which encircles the cavity wall and opens into the cavity. Accordingly, the fluid is directed by the fluid outlet such that it will flow radially around the cavity wall in the groove. As the fluid supplied to the groove from the passageway increases the fluid will be forced from the groove opening and have a laminar flow over the cavity wall surface. The cavity is beneficially cylindrical and the lubricating fluid flowing from the groove opening will continue to flow radially around the circumference of the cavity wall. The lubricating fluid is thereby distributed in a laminar, i.e., non-turbulent, flow over the entire bearing surface of the cavity wall.

The lubricating fluid flowing from the cavity opening remains in continuous contact with the cavity wall as it is distributed throughout the cavity wall bearing surface. The supply of fluid from the passageway can be properly controlled to ensure that a contiguous stream of lubricating fluid will flow from the fluid outlet, around the groove and over the cavity wall during the desired operating period. Preferably, multiple passageways and fluid outlets are utilized to supply lubricating fluid to each groove provided around the cavity wall. Beneficially, multiple grooves may also be provided.

In operation, by providing a lubricating fluid substantial tangent to the surface of a cylindrical cavity and at an appropriate velocity which is easily computed using well-known principals of physics, a lubricating fluid will have a laminar flow over the bearing surface of the cavity wall and will be distributed over the entire bearing surface of the cavity wall in a measured and controlled manner.

The laminar flow of lubricating fluid may also serve as a fluid bearing to support a moving body as it slides across the surface of another body or to support a stationary body, so long as the passageway continues to supply fluid to the cavity at the appropriate velocity.

Accordingly, the relative movement between adjacent parts not required for distributing the lubricating fluid, and a controlled and steady flow of lubricant over the entire bearing surface is provided in a manner which allows precise control of the thickness and speed of distribution of the lubricating fluid on the bearing surface.

FIGS. *7a–7f* depict alternative groove configurations in accordance with the present invention.

DESCRIPTION OF THE PREFERRED EMBODIMENT

Figure 1:
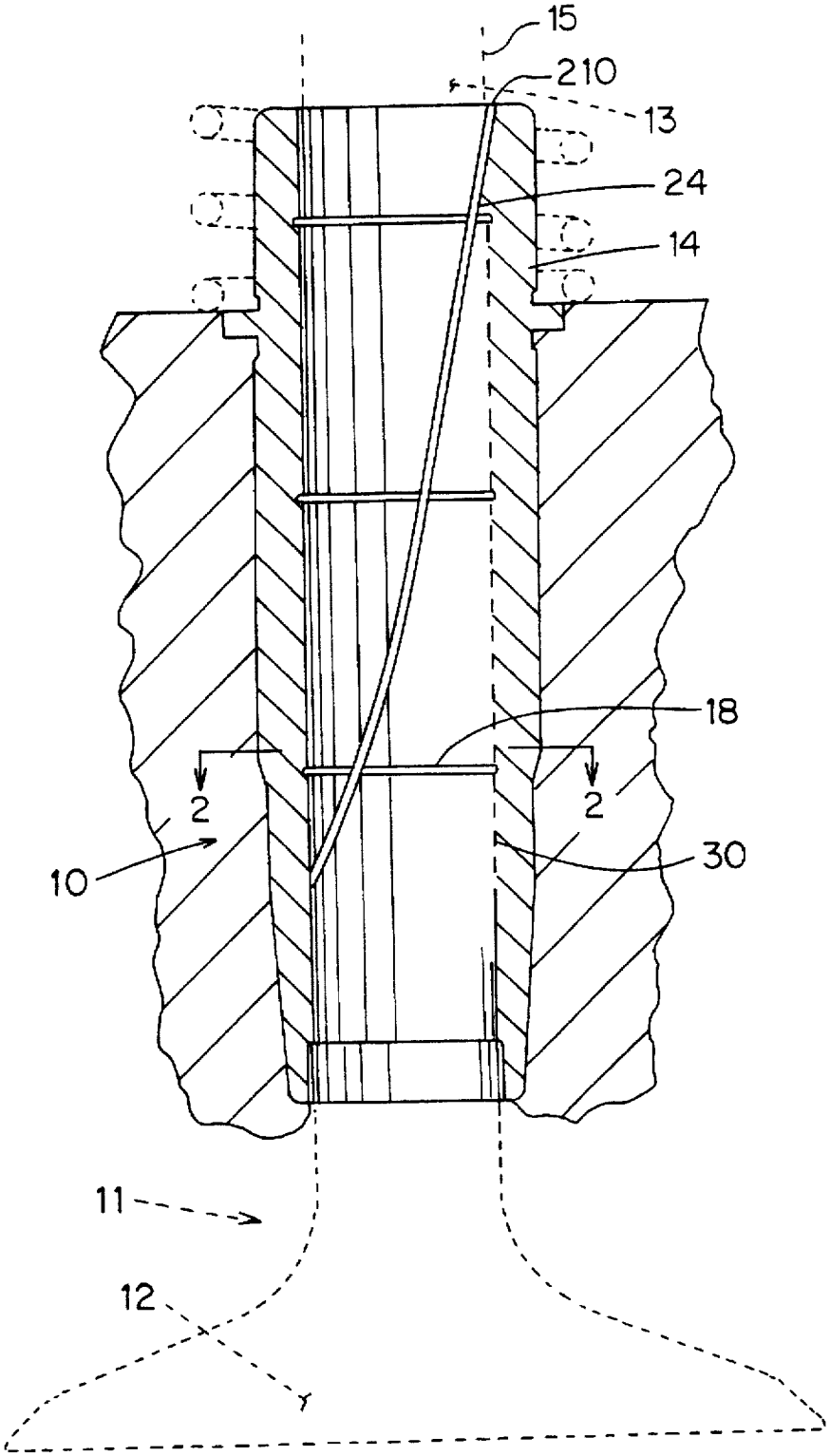
FIG. 1 is a side view of a valve guide and valve of a type suitable for use in an internal combustion engine in accordance with the present invention.

FIG. 1 depicts an assembly 10 which includes a conventional valve 11 having a valve head 12 and valve stem 13 which is guided by the valve guide 14 for sliding movement with respect thereto. The valve guide 14 has a cavity or opening formed therein which is substantially cylindrical in shape and is defined by wall 30. The surface of the wall 30 serves as a bearing or sliding surface with respect to the outer surface 15 of the valve stem.

Four machined passageways or tubes 24 are provided in the valve guide 14 to supply lubricating fluid 210 to the cavity formed by wall 30 of the valve guide. Three machined grooves 18 are formed around the cavity of the valve guide 14 for receiving lubricating fluid from the passageways 24. The grooves 18 preferably encircle and hence surround the cavity wall 30. Although four passageways 24 and three grooves 18 are depicted, it will be understood that the number of grooves and passageways depicted in the preferred embodiment is merely exemplary and a lesser or greater number of passageways and/or grooves may be desirable or necessary for a particular implementation.

Figure 2:
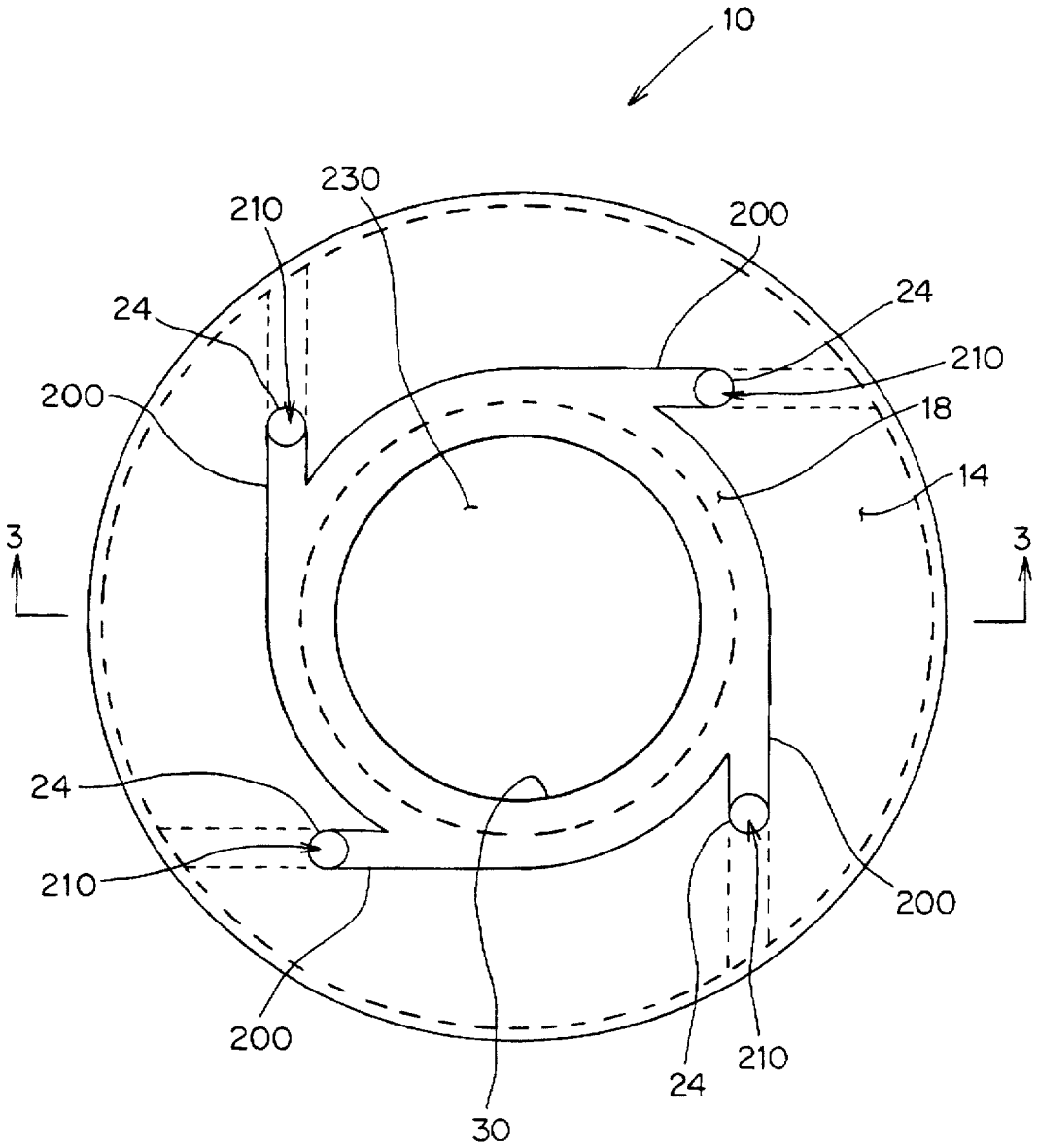
FIG. 2 is a cross-sectional view of the valve guide shown in FIG. 1.

FIG. 2 depicts a cross-section of the valve guide 14 at the bottom groove 18 in the valve guide cavity 230. A cross-section at the upper and middle grooves 18 would be similar, except that the disposition of the passageway at these other grooves 18 would vary somewhat from that shown in FIG. 2. As shown, the four passageways 24 feed lubricating fluid 210 by way of fluid output ports 200, to the groove 18. The fluid output ports 200 are formed to merge tangentially with the groove 18 to thereby direct the lubricating fluid 210 substantially tangential to the groove 18 and hence also substantially tangent to the wall 30 of the cavity 230 as the lubricating fluid 210 is supplied to the groove 18. The fluid 210 is provided by each of the passageways 24 at a substantially identical velocity, although different fluid flow velocities at each passageway could be utilized if desired.

The velocity is such that, with the fluid 210 directed as shown by fluid output ports 200, the fluid will flow in a single radial direction, shown to be counter-clockwise, around the groove 18. Because of the radial flow of the fluid 210 in the groove 18, a centrifugal force is developed which corresponds to the velocity of the lubricating fluid 210 fed from the passageways 24 via the outlets 200 into the groove 18. The centrifugal force acts to force the lubricating fluid 210 against, and to maintain contact with, the groove wall surface as it circles around the periphery of the cavity 230 until the volume of fluid 210 introduced into the groove 18 forces fluid to flow from the groove 18 and into the cavity 230. In a test model the fluid 210 was fed into output port 200 at an input velocity of 100 inches per second. At the above noted input velocity, the lubricant 210 was subjected to a centrifugal force of approximately 20 g's as it traveled circumferentially around the groove 18. The centrifugal force causes the fluid 210 which enters the groove 18 to be in continuous contact with the groove surface while the fluid remains in the groove 18. The lubricant 210 is continuously input into ports 200 and thus is continuously introduced into groove 18 during the selected operation period.

It will be understood that, if desired, the groove 18 could be eliminated and the fluid 210 directed by fluid output ports 200 directly and tangentially onto the surface of wall 30 of cavity 230. However, testing appears to indicate that it is preferable for the fluid 210 to first be introduced into a groove and thus channeled or guided radially around the cavity prior to flowing onto the bearing surfaces.

Figure 3:
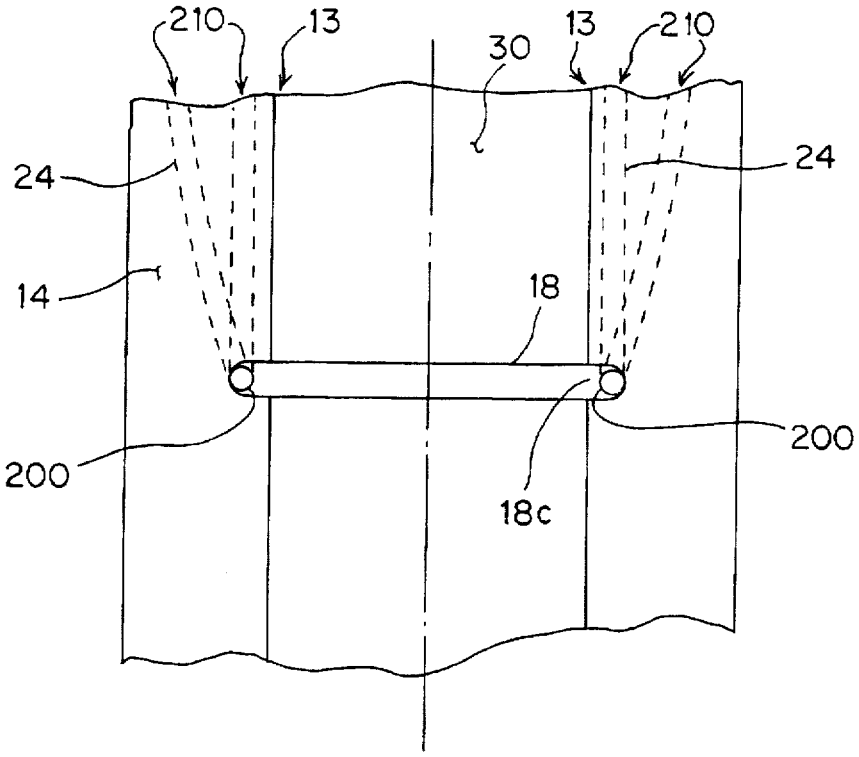
FIG. 3 is a side-sectional view through the center of the valve guide as depicted in FIG. 2.

As shown in FIG. 3, the grooves 18 have a cross-section which is shaped to form a semi-circle with extended side surfaces. However, virtually any cross-sectional shape including, but not limited to, tear drop, triangular, square or rectangular shaped grooves may be utilized. As depicted in FIG. 3, the groove 18 includes the groove opening **18*a* which opens into the cavity 230. As the volume of the lubricating fluid 210 introduced by the passageways 24 through the outlet ports 200 and into the groove 18 increases, fluid flowing within the groove 18 is forced through groove opening 18*a* and onto the wall 30 of the cavity 230**.

Although the groove opening **18*a* is shown to be substantially equal to the diameter of the semi-circular portion of the groove, it should be noted that for particular implementations the opening 18*a* may be wider or narrower than other portions of the groove. Further, the relationship between the size of the groove 18 and the size of the passageways 24 and outlet ports 200** is only exemplary, since the sizing of each of these elements will be determined by the particular application. In any event, those skilled in the art will clearly understand the theory and practicalities of designing these elements for the desired implementation so as to function in accordance with the present invention.

FIGS. *7a–7f* depict various exemplary alternative groove shapes which could be preferred for certain implementations. Although FIGS. *7a–7f* depict a number of different groove shapes it should be emphasized that the groove shapes disclosed herein are simply intended as examples since virtually any shape which will serve as a channel or path for guiding the flow of the introduced lubricating fluid in accordance with the principles described herein can be utilized.

Based upon operation of our test model, it appears that it may be beneficial in certain, although not necessarily all, implementations for the groove opening 18*a* to be no greater than the diameter or widest portion of the outlet port 200. It also may be preferable that the depth of the groove 18 be approximately two times the diameter or widest dimension of the port 200. Although passageways 24 and outlet ports 200 are depicted as cylindrical, the shape of the passageways and outlets are not necessarily limited thereto, but could take any shape which is deemed desirable for the applicable implementation. For example, if the outlet ports 200 each have a diameter of approximately 0.125 inches. The depth of the groove 18 might be approximately 0.25 inches. The length of the outlet ports 200 themselves are preferably at least twice the diameter or widest portion of outlet port 200. Hence, in the above example it may be beneficial for the passageways 200 to have a length of around to 0.25 inches. Once again the dimensional relationships discussed above are intended only to provide insight into certain practical parametric relationships which appear beneficial from our test model. However maintaining these relationships is not mandatory, and it will be understood that depending upon the particular implementation of our invention it may be desirable to deviate from the relationships discussed above.

Figure 4:
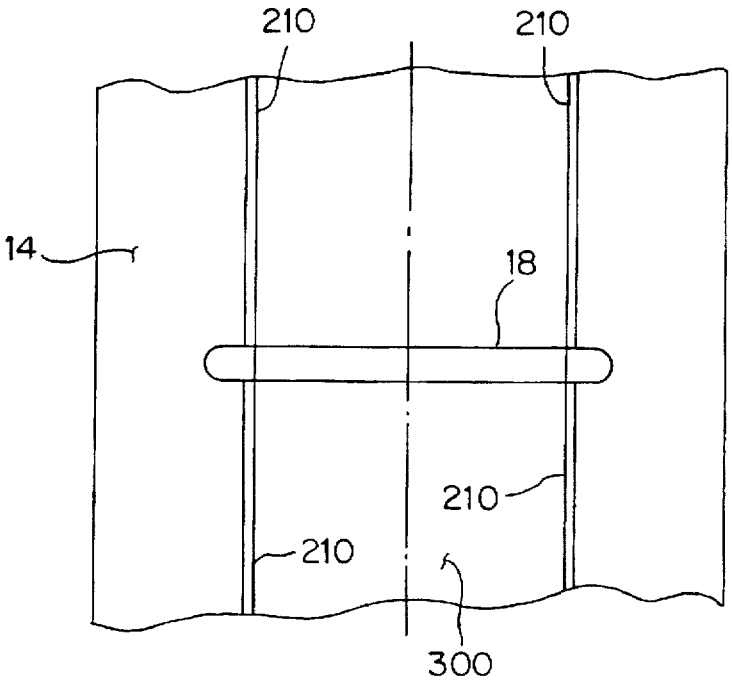
FIG. 4 depicts the laminar flow of the lubricating fluid over the bearing surface of the cavity wall of the valve guide depicted in FIG. 3.

FIG. 4 depicts the flow of the lubricating fluid 210 over the wall 30 of the valve guide cavity 230 in accordance with the present invention. More particularly, as the amount of fluid 210 supplied to the groove 18 increases, the lubricant 210 will continue to encircle the cavity 230 in the groove 18 until the volume of fluid 210 introduced to the groove 18 exceeds the groove's capacity thus forcing fluid 210 to flow from the groove 18 through groove opening 18*a* onto the wall 30 of the cavity 230. The fluid 210 continues, after leaving the groove 18, to flow radially around the circumference of the cavity 230 at a velocity sufficient to develop a centrifugal force on the lubricating fluid 210 such that a laminar flow is maintained along the bearing surface of the cavity wall 30.

As shown in FIG. 4, the lubricating fluid 210 which has been forced from the groove 18 has a laminar flow (i.e., a smooth rather than turbulent flow) over the surface of the cavity wall 30. The laminar flow should be maintained over the entire bearing or sliding surface of the cavity wall 30. In this particular embodiment, the valve stem 13 extends through the entire cavity 230. Therefore the velocity of the lubricating fluid 230 supplied to the groove 18 must be sufficient to overcome friction, gravity and any other forces known to the skilled artisan, which will act upon the fluid 210 after its introduction into the groove 18 via the passageway outlet ports 200, so that the fluid 210 will have a laminar flow in a continuous stream from the groove opening 18*a* and around the circumference of the cavity wall 30, as shown in FIG. 4, to thereby cover the entire surface within the cavity 230. That is, the lubricant 210 must be forced by the centrifugal force acting thereon and corresponding to the introduction velocity, to remain in constant contact with the wall 30 of the cavity 230 as it flows over the bearing surface.

The lubricating fluid 210 can be dispelled from the valve guide cavity 230 and collected for filtering and recirculation in any number of ways which are well known to those skilled in the art. It will also be recognized that as the valve stem 13 moves up and down in the valve guide cavity 230, it will be in constant contact with the lubricating fluid 210 flowing over the bearing surface of the cavity wall 30. A portion of the lubricating fluid will normally attach itself, by for example capillary action, onto the valve stem 13. However, the fluid 210 which remains on the cavity wall 30 should have a sufficient velocity so as to continue to maintain a laminar flow along the cavity wall 30 until it egresses the cavity 230.

As discussed above, the velocity of the fluid 210 as it enters the groove 18 must be sufficient to overcome any losses in the velocity of the fluid between its entry into the groove 18 from the outlet ports 200 and completion of its flow over the entire bearing or sliding surface of the cavity 230. Such losses will typically be caused, for example, by friction and gravitational forces acting on the fluid as it flows through the groove 18 and over the surface of cavity wall 30. Hence, the input velocity of the lubricating fluid 210 must be such that a centrifugal force sufficient to force the fluid 210 against the wall 30 continues to act on the fluid 210 as it flows over the surface of the cavity wall 30 to ensure a laminar flow over the entire bearing or sliding surface of the cavity.

As shown in FIG. 4, the lubricant which egresses the groove 18 via opening 18*a* directly flows onto the surface of cavity wall 30. The lubricant maintains a laminar flow over wall 30. The laminar flow beneficially continues to a discharge point (not shown) beyond the bearing surface of the cavity wall 30 if the input velocity is properly selected as discussed above.

As discussed above, the fluid enters the groove 18 tangentially through the four outlet ports 200. In the test model, the velocity of the fluid entering the groove 18 was approximately 100 inches per second. The fluid 210 introduced to the groove 18 immediately conforms to the grooves radius curvature and is subject to a centrifugal force which is sufficient to force the fluid 210 against the surface of groove 18 as it circles the periphery of the cavity 230. In the test model, the lubricant fluid's introduction velocity caused the fluid to be subject to approximately 13.3 g's of centrifugal force as it circled the periphery of the cavity 230 after egressing from groove 18.

In operation, fluid is delivered to the grooves 18 at a high velocity via the passageways 24. The fluid is directed from the passageways 24 tangential to the groove 18 by the passageway output ports 200. The lubricating fluid 210 in the groove 18 travels in a single radial direction around the periphery of the cavity 230 such that a centrifugal force, corresponding to the velocity of the fluid introduced to the groove 18, acts on the fluid 210 flowing in the groove 18 to force the fluid 210 to remain in contact with the surface of groove 18. Although the required centrifugal force can vary depending on the desired implementation, our tests have shown that centrifugal forces significantly above gravitational forces will provide very good flow characteristics. For example, the centrifugal force on the fluid flowing within the groove may beneficially be of the order of 10 g's to 35 g's.

As the volume of fluid 210 introduced to the groove 18 increases, the diameter of fluid flow path of lubricant particles flowing within the groove 18 decreases and hence the rotational fluid velocity may actually increase between its introduction into the groove 18 via ports 200 and its egress from the groove 18 via opening 18*a*. In effect, the fluid particles form a spiral towards the opening 18*a* of groove 18. The tangential velocity of the fluid will normally remain essentially constant as it spirals inward, even though slight friction and gravitational losses may be experienced. The rotational speed of the fluid, i.e., revolutions per minute, increases as it spirals inward because the radius of the circumferential flow continues to decrease as the fluid particles move towards the opening 18*a*. As the fluid discharges from the opening 18*a*, the centrifugal forces on the fluid in our test model were approximately 20 g's.

The velocity of the fluid 210 entering the cavity remains high and accordingly the fluid continues to flow in a continuous non-turbulent stream in a single radial direction along the cavity wall 30. By selecting the proper velocity for the fluid entering the groove 18, the lubricant 210 flowing from the groove opening 18*a* will remain in contact with the cavity wall 30 and continue its circumferential laminar flow over the wall 30 so long as lubricating fluid 210 continues to be introduced into the cavity 18 by the passageway 24 and port 200. This is because, as the fluid 210 continues its flow over the cavity wall 30, a centrifugal force, corresponding to the velocity of the lubricating fluid, acts on the fluid stream such that the fluid is forced against the cavity wall 30. Accordingly, a laminar, non-turbulent flow occurs around the circumference of the cavity 230. As the fluid continues its flow along the surface of cavity wall 30, its velocity will decrease somewhat due to friction, gravitational and potentially other forces so these forces must be considered in determining the initial introduction velocity of the lubricating fluid 210 into the grooves 18. As indicated above, the introduction velocity for the particular application can be easily computed in a conventional manner using well known scientific principles and engineering formulations. Accordingly, these techniques are not described herein to avoid providing superfluous and unnecessary information.

It will be understood by those skilled in the relevant art, that the materials utilized for the relatively moving parts and the composition of the lubricant can be selected for the particular implementation in any known manner. Further, although multiple grooves are shown in the preferred embodiment, any number of grooves may be utilized. That is for a particular implementation, a single groove may be entirely appropriate, or a large number of very closely spaced grooves may be desirable or required.

In certain applications, including lubrication of the sliding surfaces of a valve guide, it may be desirable to introduce fluid to a sliding surface before initiating the relative movement respective parts. For example, in the preferred embodiment fluid could be beneficially introduced into the grooves 18 and onto the cavity wall 30 prior to initiating movement of the valve stem 13 so that lubricant 210 is distributed over the entire bearing surface of the valve guide 14 before the valve 11 begins its first stroke. This will avoid unnecessary wear of the valve stem 13 and guide cavity wall 30 at engine start-up. Alternatively, the invention could be utilized to only operate prior to initiation of engine start-up, for example, just prior to initiating movement of the valve stem 13, and thereafter, only the movement of the valve stem 13 with respect to the valve guide 14 would be relied upon to continue distribution of the lubricating fluid 210 on the bearing surfaces of the cavity wall 30 and valve stem 13 during actual engine operation.

It will also be understood that although the passageway output ports 200 are shown to direct the fluid from the passageways 24 substantially tangential to the groove 18, such an orientation is not absolutely necessary. Rather, so long as the fluid is directed so as to flow within the groove in a single radial direction and at a sufficient velocity to develop the necessary centrifugal force to ensure the laminar flow is maintained over the entire bearing surface, the ports 200 can be angled in any desired manner with respect to the groove 18.

As noted above, although it is preferred that the lubricating fluid 210 be introduced into a groove 18 to channel the fluid 210 around the cavity 230 prior to actually beginning its flow on the bearing surfaces of the cavity wall 30, the groove 18 could be eliminated and the lubricating fluid 210 directly ported by the output ports 200 onto the cavity wall 30. This may result in some undesirable dispersion of the fluid flow. However, any such resulting degradation in the flow of the lubricating fluid along the bearing surfaces of the cavity wall 30 may be acceptable for the particular application of interest.

As depicted in FIG. 4, the thickness of the flow over the cavity surface 30 remains substantially constant. Virtually no turbulence was detectable in our test model. Notably, valve guide 14 can be rotated or oriented in any manner without effecting the steady laminar flow as depicted in FIG. 4 over the surface of the cavity wall 30.

Circulating lubricating fluids not only lubricate bearing or sliding surfaces but also serve as a vehicle for heat transfer. For example, in an internal combustion engine, circulating lubricant will continuously remove heat from the valve cylinders and other engine components. Contrary to conventional teaching that certain fluids cannot maintain a laminar flow with Reynolds' numbers greater than 2000, using water as a lubricant, the test model of the present invention had a laminar flow of lubricant along the surface of groove 18 and continuing onto surface 30 of the cavity 230 at a very high Reynolds'number of approximately 20,000. Hence, although conventional fluid mechanics teach that heat transfer to a fluid with laminar flow is poor, the test model of the present invention provided exceptional heat transfer qualities. This is because laminar flow is maintained at a very high Reynolds'number, as will be understood by those skilled in fluid heat transfers.

Figure 5:
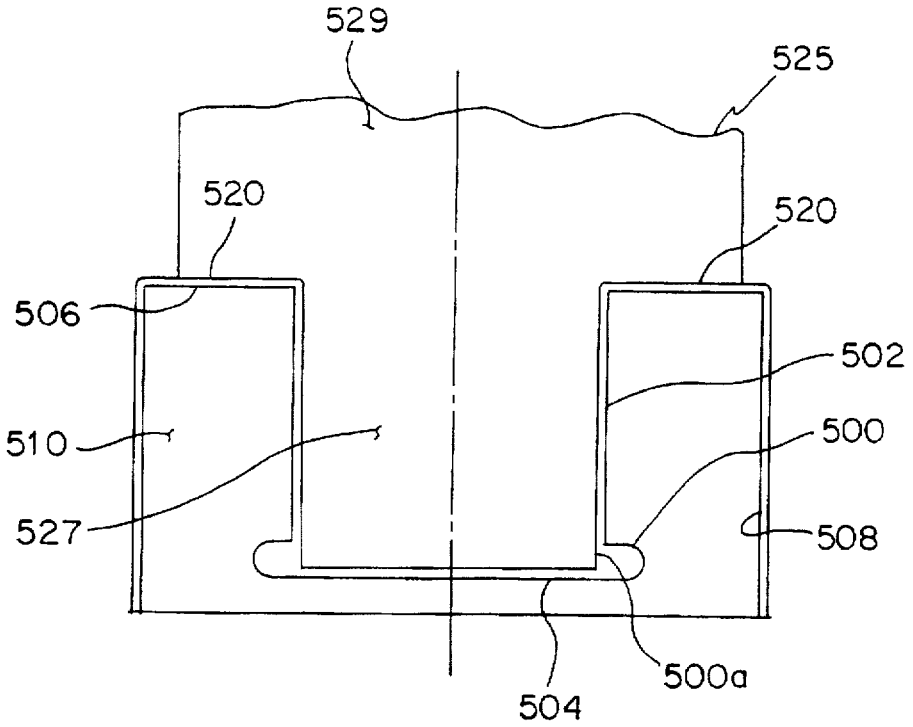
FIG. 5 depicts the flow of the lubricating fluid in accordance with the present invention to provide a fluid bearing.

FIG. 5 depicts an implementation of the invention wherein the laminar flow of the lubricant provides a bearing surface and hence forms a fluid bearing. As shown in FIG. 5, a body 510 includes a groove 500 to which a lubricating fluid 520 is introduced in a manner similar to that described in connection with FIGS. 1–4 implementation. Groove 500 is substantially circular and the lubricant is introduced to flow in a single radial direction around the groove 500 as discussed above in the valve guide implementation. The fluid 520 is supplied to the groove 500 at a velocity which results in a centrifugal force acting on the fluid 520 as it radially flows in the groove 500. The centrifugal force forces fluid 520 against the surface of groove 500.

The volume of the fluid 520 introduced to the groove 500 increases to the point where a portion of the fluid 520 is forced from the groove 500 via groove outlet or opening 500*a* and onto the walls 502 and 504 of body 510. The lubricant 210 which is forced onto wall 502 streams in a laminar flow around the circumference of the cylindrical opening formed by wall 502. The fluid also flows spirally along wall 504 which forms the bottom surface of the opening in body 510. Body 525 includes a cylindrically shaped portion 527 which extends from a main body portion 529 of the body 525. Cylindrical portion 527 is movable in and out of the cylindrical opening formed by wall 502 in body 510.

When inserted into the opening of the body 510, the outer side surfaces of cylindrical portion 527 slides past the cylindrical wall 502 of body 510. The laminar flow of the lubricating fluid 520 over the wall 502 surface provides a lubricating layer between the adjacent surfaces of the cylindrical portion 527 and the opening in body 510 as body 525 is lowered. Once fully lowered, lubricating fluid 520 continues to be supplied to the groove 500 so that a laminar flow of lubricating fluid 520 is maintained over wall 502 such that the body 525 is held substantially centered within the opening of the body 510. The fluid layer formed on the bottom surface 504 of the opening in the body 510 as well as the fluid layer formed on the upper horizontal surface 506 of the body 510 serve as fluid bearings to support the weight of the body 525 such that direct contact between the outer surfaces of body 525 and surfaces 504 and 506 of body 510 is avoided.

In operation, fluid is introduced into the groove 500 at a high velocity such that a large centrifugal force, typically on the order of tens of g's act on the fluid which flows in a single radial direction around the groove 500. As the groove 500 fills with lubricating fluid 520, the fluid 520 is forced from the groove 500 via the opening 500*a* and continues its flow in a single radial direction around the cylindrical opening formed by wall 502 and along the bottom surface of the opening formed by wall 504.

The lubricating fluid egressing from opening 500*a* has a laminar flow over walls 502 and 504. In the case of wall 502, the fluid continues to flow in a single radial direction around the circumference of the opening in the body 510 until wall 502 is entirely covered. The fluid continues past the end of wall 502 and onto wall 506. Hereto, a laminar flow is maintained over the surface of wall 506. In the case of wall 504, the fluid flows in a spiral pattern until the entire surface of wall 504 has been lubricated. Beneficially, a drain opening may be provided at the center of wall 504, although this not believed to be necessary for all applications.

To ensure a laminar flow of fluid 520 over wall 502, the velocity of the lubricating fluid introduced into the groove must, as discussed above, be sufficient such that the fluid flowing from the groove opening 500*a* onto the surface of wall 502 has a centrifugal force acting on it as it flows radically around the periphery of the opening which forces the fluid 520 against the surface of wall 502.

The velocity of the fluid 520 entering the groove 500 must also be sufficient to ensure such that a centrifugal force on the fluid just prior to egressing the opening 500*a* will have a laminar flow over the surface of walls 504 and 506. The exact theory supporting the operation of the present invention to provide the laminar flow over the surfaces of walls 504 and 506 is not completely understood. However, it has been demonstrated in the tests performed that by introducing the fluid into the groove 500 at a velocity sufficient to ensure the fluid egressing the opening 500*a* has a centrifugal force acting thereon which exceeds, by a factor of 10 or more, the force of gravity which would tend to separate the fluid 520 from the surface of wall 502, a laminar flow is maintained, not only over wall 502, but also over the surfaces of walls 504 and 506 and a laminar layer of fluid will completely cover these surfaces. As further indicated in FIG. 5, tests have also shown that the laminar flow can be made to continue along the surface of sidewall 508 as it flows over the outer edge of wall 506, so long as the input velocity is sufficiently high.

Figure 6:
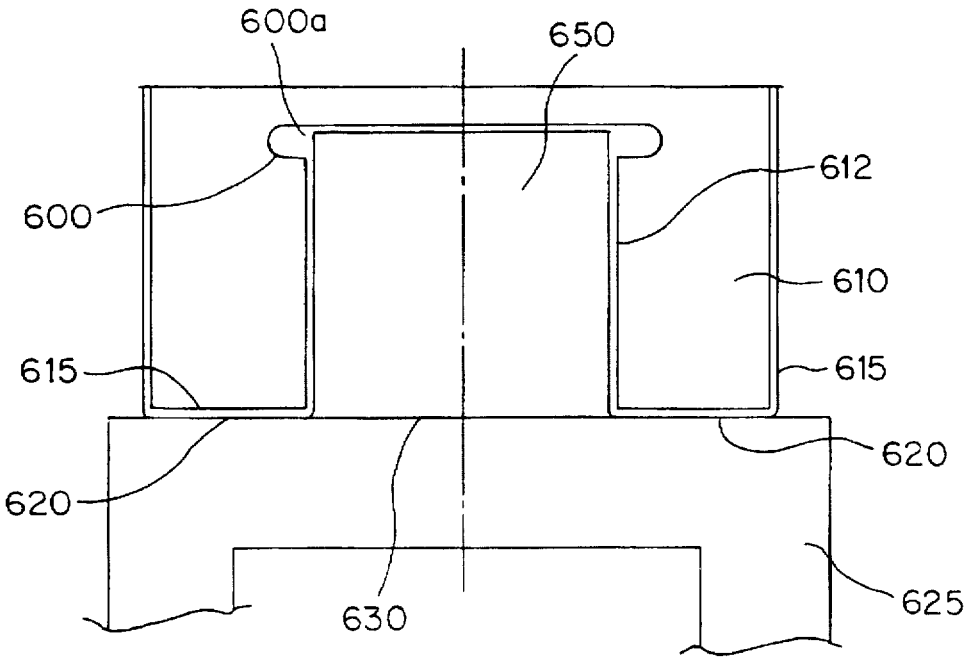
FIG. 6 depicts the flow of lubricating fluid to provide a fluid bearing between sliding surfaces of relatively moving members in another configuration in accordance with the present invention.
Figure 7A:
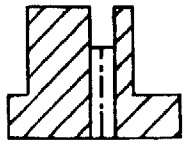
Figure 7B:
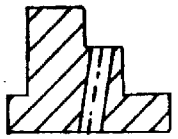
Figure 7C:
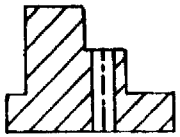
Figure 7D:
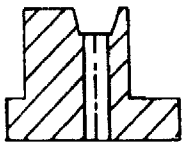
Figure 7E:
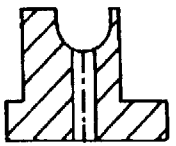
Figure 7F:
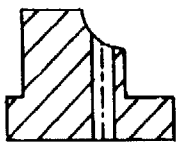

Turning now to FIG. 6, another implementation of the invention to form a fluid bearing is shown. In this particular implementation, body 610 includes a groove 600 with opening 600*a*. Body 610 slides on a surface 630 of a body 625. A lubricating fluid 620 is fed into the substantially circular groove 600 as described above, such that the fluid flows in a single radial direction around the groove 600. The fluid 620 fills the groove 600 and flows onto the surface of wall 612 of the body 610. The velocity of the fluid 620 introduced to the groove 600 is sufficiently high to cause the fluid 620 entering the opening 650 to have a laminar flow over wall 612 in a single radial direction around the circumference of the opening 650. More particularly, the velocity of the lubricating fluid 620 introduced into the groove 600 must be sufficient to cause the velocity of the fluid 620 as it flows over the surface of wall 612 to develop a centrifugal force large enough to overcome those forces, including gravity which will tend to separate the fluid 620 from the surface of the wall 612.

As discussed above in connection with FIG. 5, if the introduction velocity is properly selected, the fluid will continue its laminar flow from the surface of wall 612 over the surface of wall 615 of the body 610. The layer of fluid which is formed on the surface of wall 615 serves to lubricate the sliding surfaces of body 610 and body 625, i.e., surfaces 615 and 620, thereby reducing friction which would resist the relative movement of body 610 with respect to body 625. The fluid layer formed on the surface of wall 615 further serves as a fluid bearing for supporting the weight of body 610 such that no direct contact is made between surface 615 of body 610 and surface 630 of body 625 from which body 610 is supported. So long as the fluid continues to be introduced to the groove 600, the fluid layer 620 between surfaces 615 and 620 will continue to provide a fluid bearing between bodies 610 and 625. Depending upon the weight of the body 610, it may be necessary to establish the fluid layer 620 along the surface of wall 615 of body 610 prior to supporting of body 610 from body 625.

The implementations shown in FIGS. 5 and 6 are merely exemplary of the types of configurations that might be utilized in particular implementations of the present invention requiring fluid bearings, and are not intended to be limiting. It will be understood by those skilled in the art that the invention can be implemented in any number of configurations to form a fluid bearing surface between a support base and a body which is supported therefrom whether or not the body remains stationary or is movable with respect to the base.

As described above, the invention provides enhanced lubrication of adjacent surfaces of relatively moving parts. Implementations of the inventions are also described for providing a fluid bearing between a supporting load bearing surface and an adjacent surface of the load being supported. The invention is extremely simple to implement and does not rely on the movement between relatively moving parts for distributing lubricant over the bearing surfaces. The invention provides enhanced lubrication characteristics even after lubricated parts have been subject to wear and thus degradation of lubricant distribution due to component wear is reduced substantially if not eliminated all together. Utilizing the invention, a bearing surface can be entirely lubricated prior to initiating relative movement of parts and components. The described invention provides a consistent supply and distribution of the lubricant over the sliding or bearing surfaces in a controlled and highly efficient manner.

Although particular implementations and applications of the invention have been illustrated and described in detail above, it is to be understood that the invention is not limited thereto. Various changes could be made to the arrangement of parts in the above-described implementations without departing from the spirit and scope of the invention as will be understood, by those skilled in the art, from this disclosure. It is also to be understood that the invention can be adapted to numerous applications which require a lubricating layer to be formed between parts which have relative motion with respect to each other or which require a fluid bearing to be formed between a support surface and a supported object.

What is claimed is:

1. A system for providing a lubricating fluid between a wall forming a cavity and a member passing through the cavity, comprising:

a passageway for supplying fluid to the cavity at a velocity; and a fluid outlet for introducing the fluid from the passageway to the cavity such that a centrifugal force, corresponding to the velocity, acts on the fluid flowing from the fluid outlet to cause the fluid to have a laminar flow over the cavity wall.

2. A system according to claim 1, where said fluid outlet is disposed such that said fluid is directed to flow in a single radial direction.

3. A system according to claim 1, further comprising a groove encircling the cavity wall and opening into the cavity, wherein the cavity is cylindrical and the fluid outlet directs the fluid from the passageway substantially tangential to and into the groove.

4. A system according to claim 1, wherein the cavity has a substantially circular cross-section and the fluid flows from the fluid outlet and radially around a circumference of the cavity.

5. A system according to claim 1, wherein the fluid flows over the cavity wall in continuous contact with a bearing surface of the cavity wall.

6. A system according to claim 1, wherein the fluid flows from the fluid outlet in a contiguous stream over the cavity wall.

7. A system according to claim 1, wherein the passageway is adapted to continuously supply fluid to the cavity during passage of the member through the cavity.

8. A system according to claim 1, wherein the cavity is formed by an interior wall of an engine valve guide and the member is an engine valve.

9. A system according to claim 1, further comprising at least one other passageway for supplying the fluid to the cavity at the velocity; and at least one other fluid outlet for introducing the fluid from the at least one other passageway to the cavity such that a centrifugal force, corresponding to the velocity, acts on the fluid flowing from the at least one other fluid outlet to cause the fluid flowing therefrom to have a laminar flow over the cavity wall.

10. A system according to claim 1, further comprising:

a circular groove which surrounds the cavity wall and opens into the cavity;

at least one other passageway for supplying the fluid to said cavity at the velocity; and at least one other fluid outlet for introducing the fluid from at least one other passageway to the cavity;

wherein each of the fluid outlets directs the fluid from the passageway substantially tangential to and into the groove;

wherein the centrifugal force, corresponding to the velocity, acts on fluid flowing from each of the fluid outlets to cause the fluid flowing therefrom to have a laminar flow over the cavity wall.

11. A system according to claim 1, wherein the passageway is adapted to supply a continuous flow of the fluid into the cavity during a selected operating period.

12. A system according to claim 1, further comprising a continuous groove which surrounds the cavity and opens into the cavity;

wherein the fluid outlet directs the fluid substantially tangential to the groove.

13. A system according to claim 1, wherein the cavity has a substantially circular cross-section and the fluid outlet is disposed such that the fluid will flow in a single radial direction circumferentially around the cavity.

14. A method for applying lubricating fluid between a wall forming a cavity and a member passing through the cavity, comprising the steps of:

introducing the fluid into the cavity; and inducing the fluid to flow at a velocity along the cavity wall such that a centrifugal force, corresponding to the velocity, acts on the fluid to cause the fluid to have a laminar flow over the cavity wall.

15. A method for lubricating according to claim 14, wherein the inducing of the flow causes the fluid to flow in a single radial direction within the cavity.

16. A method for lubricating according to claim 14, wherein the fluid is induced to flow continuously during passage of the member through the cavity.

17. A method for lubricating according to claim 14, wherein the inducing of the flow causes fluid flowing over the cavity wall to maintain constant contact with the cavity inner surface.

18. A method for lubricating according to claim 14, wherein the cavity is cylindrical and the introducing of fluid into the cavity includes directing the fluid substantially tangential to the cavity.

19. A method for lubricating according to claim 14, wherein the cavity is cylindrical and is encircled by a groove opening into the cavity, the fluid is introduced into the cavity by way of the groove, and the fluid enters the groove at a velocity exceeding the velocity of the fluid flowing along the cavity wall.

20. An apparatus for providing a laminar fluid flow on a surface of a body, comprising:

a groove having a substantially circular cross-section formed in the body, and having an inner surface and an opening for the egress of fluid from the groove; and at least one inlet for introducing a fluid to the groove at a velocity, such that a centrifugal force, corresponding to the velocity, acts on the fluid flowing from the groove opening so as to cause the fluid to have a laminar flow over the surface of the body.

21. An apparatus according to claim 20, wherein the body surface is an outer surface of the body and the fluid flowing onto the body surface forms a fluid bearing.

22. A system for providing a fluid between bearing surfaces of relatively moving members, comprising:

a passageway for supplying fluid at a velocity for application to a first of said members; and an outlet port for directing said fluid from said passageway such that a centrifugal force, corresponding to said velocity, acts on said fluid to cause said fluid to have a non-turbulent flow over a bearing surface of said first member.

23. A system according to claim 22, further comprising a groove, wherein said port directs said fluid from said passageway substantially tangential to and into said groove and said fluid flows over said bearing surface after egressing from said groove.

24. A system according to claim 23, wherein said groove has a substantially circular cross section and said fluid flows from said outlet port radially around said groove.

25. A system according to claim 23, wherein said port directs said fluid substantially tangential to said groove.

26. A system according to claim 22, wherein said centrifugal force exceeds the force of gravity.

27. A system according to claim 22, wherein said non-turbulently flowing fluid has a high Reynold's number.

28. A system according to claim 26, wherein said non-turbulently flowing fluid has a Reynold's number exceeding 10,000.

29. A method for providing a fluid between bearing surfaces of relatively moving members, comprising the steps of:

supplying fluid at a velocity for application to a first of said members; and directing said fluid such that a centrifugal force, corresponding to said velocity, acts on said fluid to cause said fluid to have a non-turbulent flow over a bearing surface of said first member.

30. A method according to claim 29, wherein said centrifugal force exceeds the force of gravity.

31. A method according to claim 29, wherein said non-turbulently flowing fluid has a high Reynold's number.

32. A system according to claim 31, wherein said non-turbulently flowing fluid has a Reynold's number exceeding 10,000.

33. A system according to claim 29, wherein said fluid is directed to flow in a single radial direction.

34. A method for lubricating according to claim 29, wherein said fluid is supplied continuously during a selected period of operation.

* * * * *